US005277375A

United States Patent [19]

Dearwester

[11] Patent Number: 5,277,375

[45] Date of Patent: Jan. 11, 1994

[54] SPINDLE FOR USE WITH COMPRESSED CORE WOUND PAPER PRODUCTS

[75] Inventor: Donald D. Dearwester, Hamilton, Ohio

[73] Assignee: The Procter & Gamble Company, Cincinnati, Ohio

[21] Appl. No.: 803,299

[22] Filed: Dec. 4, 1991

[51] Int. Cl.[5] ..... B65H 16/06

[52] U.S. Cl. ..... 242/68.4; 242/55.2

[58] Field of Search ..... 242/55.2, 55.53, 68.4, 242/1

[56] References Cited

U.S. PATENT DOCUMENTS

| | | | |
|---|---|---|---|
| D. 314,301 | 2/1991 | Cooke | D6/512 |
| 401,233 | 4/1889 | Wheeler . | |
| 1,316,041 | 9/1919 | Johnson . | |
| 1,778,856 | 10/1930 | Hoegger | 242/55.2 |
| 1,819,895 | 8/1931 | Hunt . | |
| 1,922,716 | 8/1933 | Robinett | 242/1 |
| 2,889,122 | 6/1959 | McConnell | 242/55.2 |
| 3,029,035 | 4/1962 | Layton | 242/55.53 |
| 3,438,589 | 4/1969 | Jespersen | 242/55.2 |
| 3,601,328 | 8/1971 | McClung | 242/68.4 |
| 3,878,998 | 4/1975 | Lazzari | 242/55.2 |
| 4,762,061 | 8/1988 | Watanabe et al. | 100/35 |
| 4,765,475 | 8/1988 | Kaysserian | 206/394 |
| 4,886,167 | 6/1989 | Dearwester | 206/389 |
| 4,909,388 | 3/1990 | Watanabe | 206/410 |
| 5,027,582 | 7/1991 | Dearwester | 53/399 |
| 5,100,075 | 3/1992 | Morand | 242/55.2 |
| 5,186,099 | 2/1993 | Qing | 242/1 X |

*Primary Examiner*—John M. Jillions

*Attorney, Agent, or Firm*—Larry L. Huston; Frederick H. Braun

[57] ABSTRACT

Disclosed is a spindle for use with compressed core wound paper products such as toilet tissue and paper towels. One end of the spindle is generally circular and adapted to fit onto a conventional dispenser. The second end of the spindle also adapted to fit onto a conventional dispenser and is wedge-shaped for inserting into the core of a compressed core wound paper product and has an edge which is generally orthogonal the longitudinal axis of the spindle. The second end of the spindle may comprise another edge, which is not encountered until the spindle is partially inserted into the compressed core wound paper product. The second edge allows for expansion of the compressed core wound paper product to a generally circular cross section.

6 Claims, 4 Drawing Sheets

SPINDLE FOR USE WITH COMPRESSED CORE WOUND PAPER PRODUCTS

FIELD OF THE INVENTION

The present invention relates to spindles used with dispensers for cellulosic fibrous structures, particularly to spindles used in conjunction with core wound paper products and more particularly to spindles used in conjunction with compressed core wound paper products such as toilet tissue and paper towels.

BACKGROUND OF THE INVENTION

Core wound paper products are in constant use in daily life. Particularly, toilet tissue and paper towels are a staple in home and industry. Such products comprise a roll of the toilet tissue or a roll of paper towels wound in a spiral around a hollow center core. The hollow center core has a volume which is not used until a spindle is inserted into the product for dispensing by the consumer.

To reduce the cost associated with this unused volume, the cores of core wound paper products have been compressed for several years. Such compression reduces, or eliminates, the volume of the core prior to use and thereby decreases the overall volume of the entire core wound paper product. Reducing the volume of the entire core wound paper product favorably affects the price and cost of transportation, storage and shelving for such products.

For example, as early as 1889, U.S. Pat. No. 401,233 issued Apr. 9, 1889 to Wheeler disclosed a flattened roll of toilet paper having an interior reinforcement. The interior reinforcement had incisions to facilitate the insertion of a suspensory device from which the toilet paper was dispensed.

Later, U.S. Pat. No. 1,005,787 issued Oct. 10, 1911 to Sibley disclosed a corrugated core for packages of wound fabric. The package is compressed into a flattened state to occupy less space during transportation and stocking.

Similarly, U.S. Pat. No. 1,316,041 issued Sep. 16, 1919 to Johnson disclosed a flattened roll of toilet tissue having a core of material made with overlapping ends. The Johnson roll was bent from the flattened state into a kidney shape for application onto a dispensing fixture when it was desired to utilize the toilet tissue wound thereon.

When the compressed core wound paper product is ready to be used by the consumer, it must be rerounded to a generally cylindrical shape having a generally circular cross section. Rerounding is often effected as disclosed in U.S. Pat. No. 4,909,388 issued Mar. 20, 1990 to Watanabe. Watanabe discloses applying lateral compressive forces to the sides of the compressed core wound paper product so that rerounding occurs due to crepes and embosses on the paper product itself.

However, with the advent of the volume savings and the cost savings associated with compressing core wound paper products, inconveniences emerged for the end user. Depending upon the materials used for construction of the core, the substrate of the paper product wound thereon, the tension with which the paper product is wound, the compressibility of the paper product, the amount of compression or flattening applied, and other parameters, it may not be convenient to even begin the rerounding process.

Particularly, when it is desired to restore the round shape of the paper product and eliminate the flattened shape used for transportation, storage and shelving, the consumer may be confronted with difficulties. For example, often the core does not return to a circular cross section, but instead remains in an obround cross-section.

The type of compression or flattening applied to the core wound paper product varies from product to product. For example, commonly assigned U.S. Pat. No. 4,886,167 issued Jun. 11, 1991 to Dearwester discloses unilaterally compressed core wound paper product. U.S. Pat. No. 4,762,061 issued Aug. 9, 1988 to Watanabe et al. discloses multi-stroke bilaterally compressed paper product. The differences between unilateral and multi-stroke bilateral compression will affect the behavior of the core wound paper product upon rerounding.

Also, the amount of compression or flattening applied to the core wound paper product varies widely between different products. For example, U.K. Patent Application 709,363 published May 19, 1954 in the name of Samson teaches diametrically flattening the cores and core wound paper product. The aforementioned U.S. Pat. No. 4,909,388 issued to Watanabe teaches flattening the core wound paper product to one half of its original volume or less and maintaining a particular flattened cross section. Commonly assigned U.S. Pat. No. 5,027,582 issued Jul. 2, 1991 to Dearwester teaches applying unilateral compressive loading sufficient only to reduce the volume of and flatten the cores without substantially flattening the paper product wound thereon. Conversely, the aforementioned U.S. Pat. No. 1,005,787 issued Oct. 10, 1911 to Sibley discloses a somewhat elastic corrugated core which has an opening after compression is applied.

Clearly the substrate of the paper product, the type (unilateral or bilateral) and amount (whether compressed to a degree or flattened) of compressive loading will also affect the behavior of the core wound paper product upon rerounding. The consumer, who is unlikely to be aware of the substrate of the paper product or the amount and type of compressive loading used in manufacturing, will not know how to accommodate all of these factors when attempting to reround the package.

However, the consumer is presented with still other difficulties and inconveniences when attempting to reround the package. For example, when lateral compressive forces are applied to the product as disclosed in the aforementioned U.S. Pat. No. 4,909,388 issued to Watanabe, the consumer expects the opposed sides of the flattened or compressed core to expand outwardly and away from each other. Ideally, each half of the core is then oriented concave inwards toward the center of the core and towards the other half.

However, both halves of the core may buckle in the same direction, forming a somewhat crescent shaped cross section. This phenomenon may be referred to as core inversion and occurs when both sides of the core buckle so that the two halves of the core are concave in the same direction.

When core inversion occurs upon rerounding, it is very difficult for the consumer to insert a spindle through the opening in the center of the core. The opening is too small to freely admit the spindle and the opposed halves of the core do not readily expand outwardly to be concave in mutually opposite directions.

However, assuming core inversion does not occur and the package properly rerounds to a generally circular cross section, the consumer still has the step of inserting the spindle through the core of the core wound paper product. Various types of spindles, and dispensers are known in the art.

For example, U.S. Pat. No. 1,819,895 issued Aug. 18, 1931 to Hunt discloses a paper dispenser having a locking tongue with a hook-shaped member. Flattened toilet tissue having a slot is slid onto the dispenser so that the shank of the tongue bears against and engages the toilet tissue.

This teaching suffers from the drawback that the toilet paper does not rotate on the locking tongue and the locking tongue must be permanently mounted to a fixture which is generally not compatible with those commonly found in the homes of today's consumer. Furthermore, toilet tissue and paper towels sold today are not provided with slots and adapting slots to such core wound paper product would require an extra step in the manufacturing process, thereby increasing the cost to the consumer and offsetting any savings recognized through compressing the core wound paper product.

U.S. Pat. No. 4,765,475 issued Aug. 23, 1988 to Kayserian discloses a container for storing and dispensing a plurality of rolls of stacked toilet tissue. The toilet tissue is inserted through a generally oval-shaped opening and onto a central support rod having a mushroom-shaped free end. This arrangement allows for providing a plurality of rolls of core wound paper product at the same time, while preventing their removal through the oval-shaped opening. However, this arrangement is not compatible with the single dispensing configuration found in most homes and most frequently used in industry. Nor does the oval-shaped opening through which the plurality of core wound paper products is inserted solve the aforementioned problems, difficulties, and inconveniences associated with the step of rerounding.

Other attempts to improve spindles used in dispensing core wound paper products have focused on the ends of the spindles. For example, U.S. Pat. No. 3,029,035 issued Apr. 10, 1962 to Layton discloses a roll supporting construction having an end with a circular recess and a circular bearing disposed therein and which conforms to the shape of the recess. U.S. Pat. No. 3,438,589 issued Apr. 15, 1969 to Jespersen discloses a dispenser which has circular shaped ends smaller in diameter than the central section of the core. The ends are recessed and press fitted into the central section of the core so that when the core wound paper product is exhausted, the core automatically falls from the dispenser.

U.S. Pat. No. 314,301 issued Feb. 5, 1991 to Cook discloses a toilet tissue roll dispenser having a notch and holes at one end. It is not clear what function, if any, is provided by the notch.

None of the aforementioned spindles or dispensers for core wound paper products eliminate the need for separate steps in rerounding the compressed core wound paper products and inserting a spindle therethrough. One inconvenience to the consumer could be eliminated if these two steps were combined.

From this review of the prior art, it is apparent there exists a need for a device to assist in rerounding a large variety of compressed core wound paper products without presenting undue difficulty or inconvenience to the consumer.

Accordingly, it is an object of this invention to overcome the problems in the prior art associated with rerounding various types of compressed core wound paper products. It is also an object of this invention to present a spindle which not only assists in rerounding the compressed core wound paper product, but which can also be used by the consumer without requiring substantial additional steps than would occur if the consumer were to use a core wound paper product which was not compressed or flattened. Finally, it is an object of this invention to provide a spindle which can be used not only with compressed core wound paper products, but with conventional dispensers as well.

BRIEF SUMMARY OF THE INVENTION

The invention comprises a spindle for use with compressed core wound paper products. The spindle has a general tubular frame with two opposed ends and a means for fitting the spindle onto a dispenser. The spindle further has a means for inserting one end of the spindle into the core of a compressed core wound paper product and a means for expanding the compressed core to a generally circular cross section.

In one embodiment the spindle has a longitudinal axis and comprises a first end having a circular cross section adapted to fit onto a dispenser. The spindle has a second end opposite the first end and which tapers to an edge which may intersect the longitudinal axis of the spindle and has a vector component orthogonal thereto. The edge has at least one cylindrical triangular surface defining an arc of a circle, which arc partially circumscribes the longitudinal axis. The cylindrical triangular surface is substantially parallel to the longitudinal axis. In this manner the second end is adapted to fit onto a dispenser. The spindle may have a second edge longitudinally inward and radially oriented outward of the first edge and having a vector component orthogonal to the longitudinal axis. A generally tubular frame joins the first and second ends of the spindle.

In a second embodiment, the means for inserting one end of the spindle into the core of a compressed core wound paper product and the means for expanding the core are generally coplanar.

BRIEF DESCRIPTION OF THE DRAWINGS

While the Specification concludes with the claims particularly pointing out distinctly claiming the present invention, it is believed the same will be better understood from the following description taken in conjunction with the accompanying drawings wherein like parts are given the same reference numeral, analogous parts are designated with a prime symbol and:

DETAILED DESCRIPTION OF THE INVENTION

Figure 1:
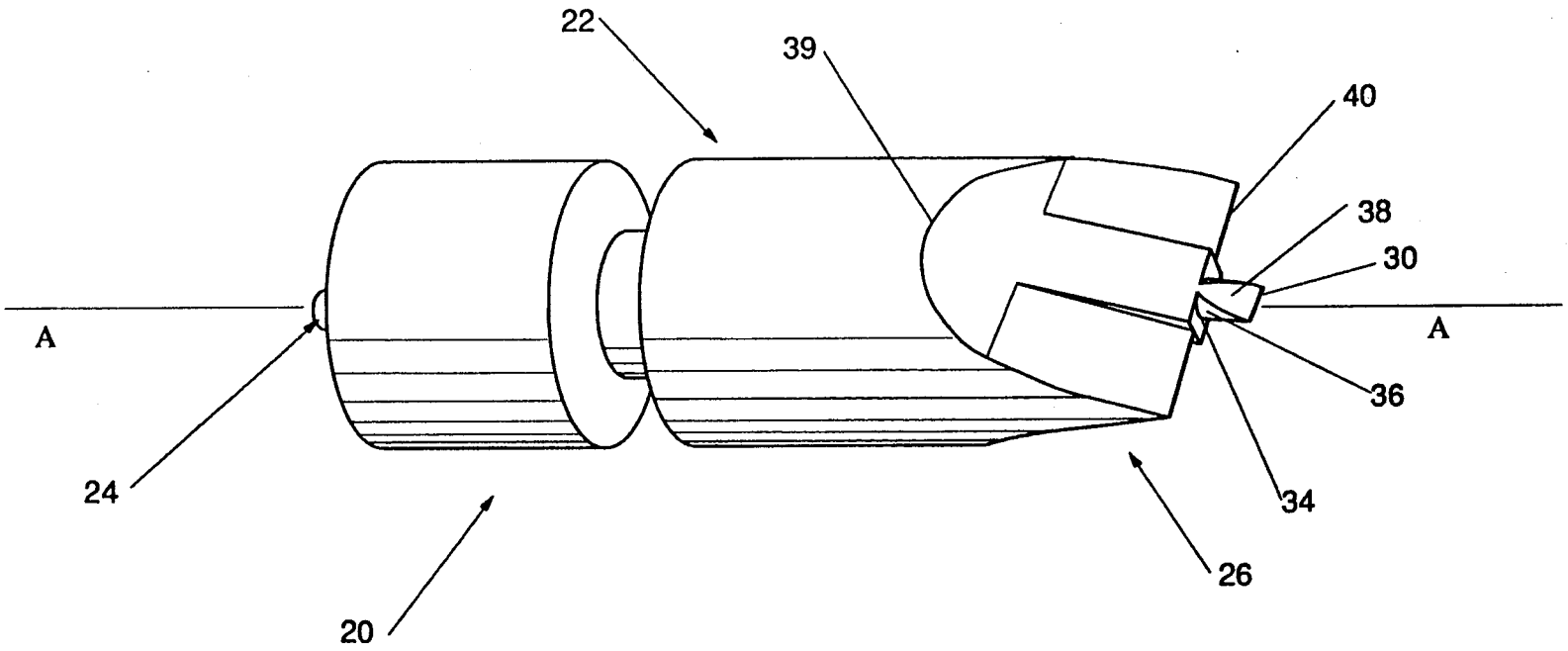
FIG. 1 is a perspective view of a spindle according to the present invention.

Referring to FIG. 1, a spindle 20 according to the present invention is used to hold core wound paper products, particularly core wound paper products which have been radially compressed or flattened as described above. It is understood, however, that the spindle 20 according to the present invention may be used with core wound paper products which are not compressed and have a hollow core which is generally circular in cross section.

As used herein a "core wound paper product" refers to the aggregate of a generally tubular hollow core, through which a spindle 20 is inserted, and a paper product such as toilet tissue or paper towels. The paper product is wound around the core in a spiral pattern.

A spindle 20 according to the present invention may be installed on any variety of dispensers. Typically a dispenser comprises two opposed blind holes. The opposed blind holes may be mounted on posts extending longitudinally from a wall, recessed into a wall, or otherwise disposed in the desired configuration.

A spindle 20 according to the present invention comprises a generally tubular frame 22 having two opposed ends 24 and 26 and defining a longitudinal axis A—A. Each of the opposed ends 24 and 26 is fitted into one of the opposed blind holes of the dispenser. The first end 24 of the spindle 20 is generally circular and adapted to fit into such a blind hole. The second end 26 tapers to an edge 30 and has a circular arc 34 longitudinally inboard of such edge 30. The first end 24 and second end 26 provide a means for fitting the spindle 20 onto a dispenser and are connected by a generally tubular frame 22.

Examining each component of the spindle 20 according to the present invention in more detail, the frame 22 and the first and second ends 24 and 26 of the spindle 20 may be made of any suitable material including a variety of plastics, such as polyolefins including polypropylene and high density polyethylene. Alternatively, the frame 22 of the spindle 20 may be made of metal or wood.

The frame 22 of the spindle 20 may be assembled from two halves which telescope into one another and are interlocked with an annular collar. The spindle 20 according to the present invention preferably further comprises a means for biasing 29 the two frame 22 halves, so that each half of the frame 22 is biased longitudinally outward and away from the other half. The biasing means 29 urges the first and second ends 24 and 26 of the spindle 20 into the blind holes of the dispenser.

It is not critical what type or manner of biasing means 29 is selected. It is only necessary that the biasing means 29 be able to maintain the spindle 20 (when loaded with the desired core wound paper product) on the dispenser as described above and until the supply of core wound paper product is exhausted—if the spindle 20 cannot otherwise maintain its disposition on the dispenser. Suitable biasing means 29 include helical wire wound coil springs as are well known in the art and which comprise no part of the present invention.

Preferably a significant portion of the frame 22 of the spindle 20 is generally circular in cross section. The line connecting the centers of the circles of such cross sections and orthogonal thereto defines the "longitudinal axis" of the spindle 20. A similar line connects the centers of the circles at the ends of the core and defines the longitudinal axis of the core. The diameter of the circular cross section portion of the frame 22 of the spindle 20 may range from about 3.0 centimeters to about 4.5 centimeters (1.2 to 1.8 inches), as desired.

Preferably, a relatively large diameter is selected for the circular cross section, so that the annular clearance between the outside diameter of the spindle 20 and the inside diameter of the hollow core (whether compressed and then rerounded or not compressed at all) is minimized. By minimizing the annular clearance between the core and spindle 20, a less noisy and obtrusive dispensing action can be achieved—particularly for compressed core wound paper products which, as noted above, typically do not reround to a perfectly circular cross section.

If the spindle 20 is to be utilized with toilet tissue, the spindle 20 may longitudinally expand from a retracted dimension between the ends of about 10.8 centimeters (4.25 inches) to an extended dimension between the ends of about 15.2 centimeters (6 inches). The retracted dimension between the first and second ends 24 and 26 must be sufficient to allow the spindle 20 to be longitudinally compressed and inserted into any variety of dispensers. Of course, if the spindle 20 is to be used with paper towels, a spindle 20 longer than that described above is necessary.

The extended dimension between the first and second ends 24 and 26 must be sufficient to allow the spindle 20 to maintain its disposition on various dispensers. The spindle 20 needs to maintain its disposition on the selected dispenser throughout several dispensing cycles, unintended impacts, and unusual forces which are applied when dispensing is initiated at the beginning of a roll (such as removing the adhered end of a roll from the sheet it overlaps), or which are applied at the end of the life of the core wound paper product (such as tearing the last sheet of the paper product from the core of the roll).

The first end 24 of the spindle 20 has a generally circular cross section and is adapted to fit onto a dispenser, and particularly is adapted to fit into one of the aforementioned blind holes of the dispenser. The generally circular cross section of the first end 24 may be the same size as the diameter of the frame 22 of the spindle 20 or, preferably (due to the preferred relatively large diameter of the frame 22), is smaller in diameter than the frame 22 of the spindle 20. The diameter of the circular cross section of the first end 24 of the spindle 20 may range from about 0.95 centimeters (0.375 inches) to about 1.3 centimeters (0.5 inches).

The frame 22 provides a means for connecting the first end 24 and the second end 26 of the spindle 20 to the other end of the spindle 20. The first and second ends 24 and 26 of the spindle 20 may be concentric with the longitudinal axis A—A, so that no eccentricity or unnecessary flutter is introduced during dispensing. However, if desired the first end 24 of the spindle 20 and/or the second end 26 of the spindle 20 may be slightly eccentric. This arrangement provides the advantage that unintended unwinding of the core wound paper product is minimized, because the spindle 20 seldom rotates without external influence when the center of gravity is at bottom dead center or is below the elevation of the mounting holes in the dispenser. In any event, both ends of the spindle 20 should be centered on a line parallel the longitudinal axis A—A, so the core wound paper product fits squarely in the dispenser and no unnecessary flutter occurs during dispensing.

Figure 2:
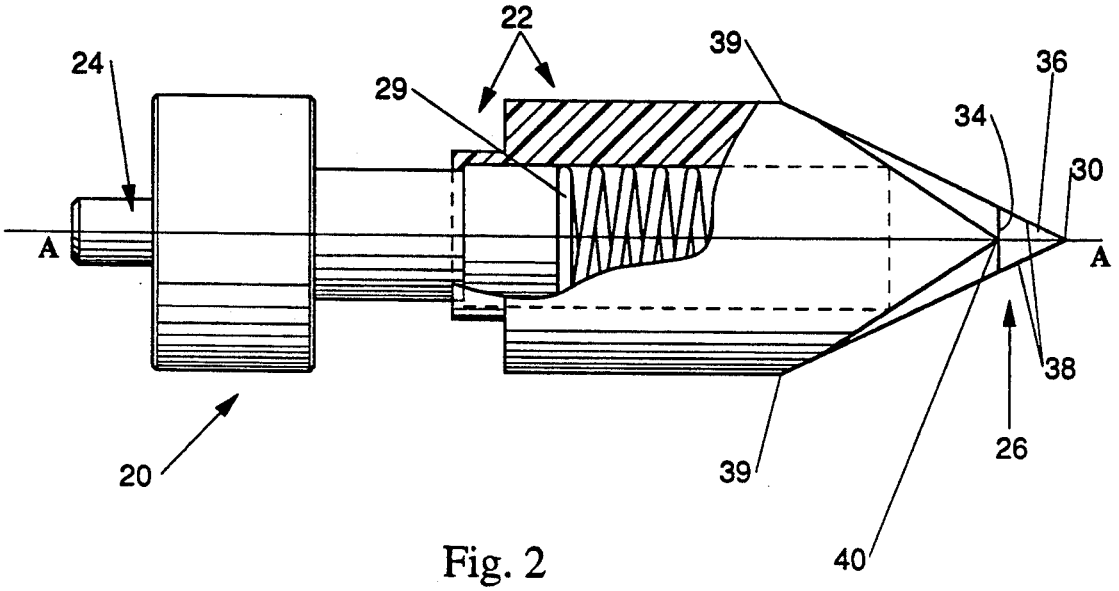
FIG. 2 is a side elevational view, shown partially in cutaway, of the spindle depicted in FIG. 1.

As illustrated in FIG. 2, the second and opposite end 26 of the spindle 20 tapers to a first edge 30 having a vector component orthogonal to the longitudinal axis A—A. The first edge 30 intersects the longitudinal axis A—A of the spindle 20 (unless an eccentric arrangement is selected) and is generally orthogonal to the longitudinal axis A—A of the spindle 20. The first edge 30 is juxtaposed with two longitudinally oriented surfaces which define arcs 34 of a circle and each of which may be shaped like a cylindrical triangle 36. The first edge 30 is at the apex of the cylindrical triangles 36 and defines the furthest extent of the second end 26 of the spindle 20. The included angle at the apex of the cylindrical triangles 36 may range from about 30 degrees to about 70 degrees, depending upon the overall longitudinal dimension of the spindle 20.

As used herein a "cylindrical triangle" refers to a generally planar surface which has three vertices connected by generally straight sides and which may be cut from the side surface of a cylinder. The two cylindrical triangles 36 are longitudinally oriented and may be longitudinally parallel. The arcs 34 defined by the cylindrical triangles 36 at least partially circumscribe the longitudinal axis A—A and are generally orthogonal to the longitudinal axis A—A, so that the two cylindrical triangles 36 are generally longitudinally oriented, if not parallel to the longitudinal axis A—A. The two cylindrical triangles 36 provide generally round surfaces juxtaposed with the second end 26 of the spindle 20, so that the second end 26 of the spindle 20 may be adapted to fit onto a dispenser, and particularly into the blind hole of a dispenser.

Figure 3:
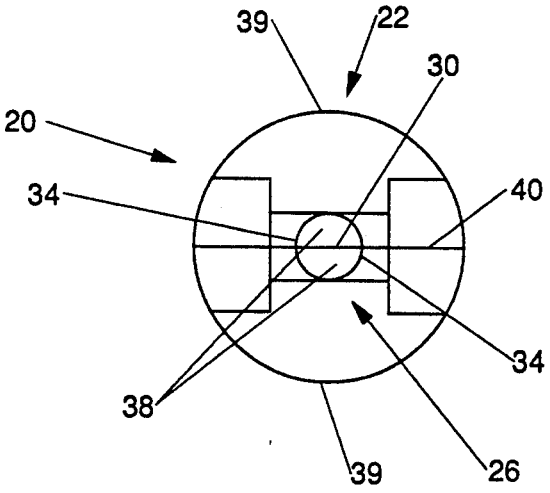
FIG. 3 is an end view of the spindle depicted in FIGS. 1 and 2.

Intermediate the two longitudinally oriented cylindrical triangles 36 are two longitudinally oriented parabolically shaped surfaces 38, as illustrated in FIG. 3. The parabolic surfaces 38 slidingly contact the inside of the flattened core as the spindle 20 is inserted into the core and initiate rerounding of the core.

The parabolic surfaces 38 converge towards the first edge 30 of the second end 26 of the spindle 20. The vertices 39 of the parabolic surfaces 38 may be juxtaposed with the circular arcs 34 defined by the aforementioned cylindrical triangles 36, and are disposed longitudinally inward of the edge 30 defining the second end 26. Preferably the two parabolic surfaces 38 and the two cylindrical triangles 36 aggregate to subtend 360° of the cross section of the spindle 20.

The first edge 30 is diametrically short enough to be easily generally centered on the core and to avoid getting hung up on the walls of the core. Even if not centered, the first edge 30 may be introduced at a slight angle to the longitudinal axis A—A of the core, rather than generally orthogonal thereto.

This first edge 30 comprises a means for inserting the second end 26 of the spindle 20 into the compressed core of a core wound paper product. The second end 26 is inserted so that the aforementioned first edge 30 is generally parallel the major axis of the cross section of the end of the compressed core and provides for easily and conveniently inserting the second end 26 of the spindle 20 into the core. It will be apparent that the second end 26 of the spindle 20 is also well adapted to fit into a circular cross section core of a core wound paper product which has not been compressed.

The second end 26 of the spindle 20 may further comprise a second edge 40 having a vector component orthogonal the longitudinal axis. The second edge 40 is preferably disposed longitudinally inward and radially outward of the first edge 30. The second edge 40 al so may be generally orthogonal the longitudinal axis of the spindle 20 and is preferably parallel the first edge 30. The second edge 40 may extend outwardly to terminate at the periphery of the circular cross section of the frame 22 of the spindle 20. The second edge 26 also defines a cylindrical triangle 36. The second edge 40 may be bifurcated by the parabolic surfaces 38 and cylindrical triangles 36 of the first edge 30. The apex of the second edge 40 may be generally coincident the bases of the cylindrical triangles 36 defined by the arcs 34 of the first edge 30, as illustrated in FIG. 2.

The included angles at the apexes of the cylindrical triangles 36 defined by the second edge 40 are preferably somewhat greater than the included angles at the apexes of the cylindrical triangles 36 defined by the first edge 30. The included angles at the apexes of the cylindrical triangles 36 defined by the second edge 40 may range from about 40 degrees to about 90 degrees, depending upon the overall longitudinal dimension of the spindle 20.

The second edge 40 comprises a means for expanding the compressed core of a core wound paper product to a generally circular cross section. The second edge 40 is inserted into the core after the first edge 30 is inserted and has provided the means for inserting the second end 26 of the spindle 20 into the core. The inside of the compressed core slidingly contacts the sides of the cylindrical triangles 36 defined by the second edge 40, until the core is expanded to the full diameter of the generally circular cross section of the tubular frame 22. In this manner the core is now rerounded.

Figure 4:
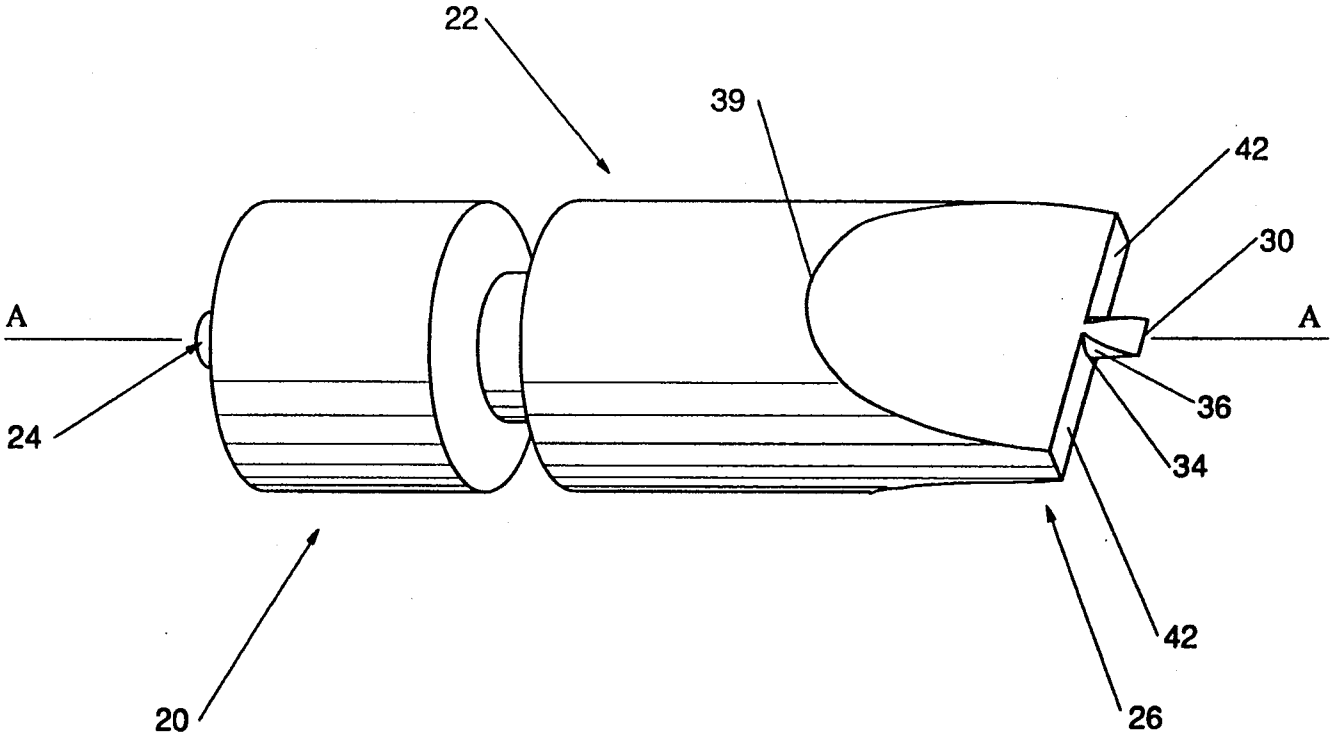
FIG. 4 is a perspective view of a second embodiment of a spindle according to the present invention.

Referring to FIG. 4, in an alternative embodiment, the means for inserting one end of the spindle 20 into the core of the core wound paper product and the means for expanding the compressed core to a generally circular cross section may be coplaner. In such an embodiment, the second end 26 of the spindle 20 has no sharply defined second edge 40. Instead, the taper from the apex of the cylindrical triangle 36 at the first edge 30 defining the first end 24 of the spindle 20 may extend outwardly in a planar fashion from the first end 24 of the spindle 20 to the outside diameter of the tubular frame 22. It is understood that the planes of the taper may be flat (as shown), convex, or concave, as desired.

Figure 5:
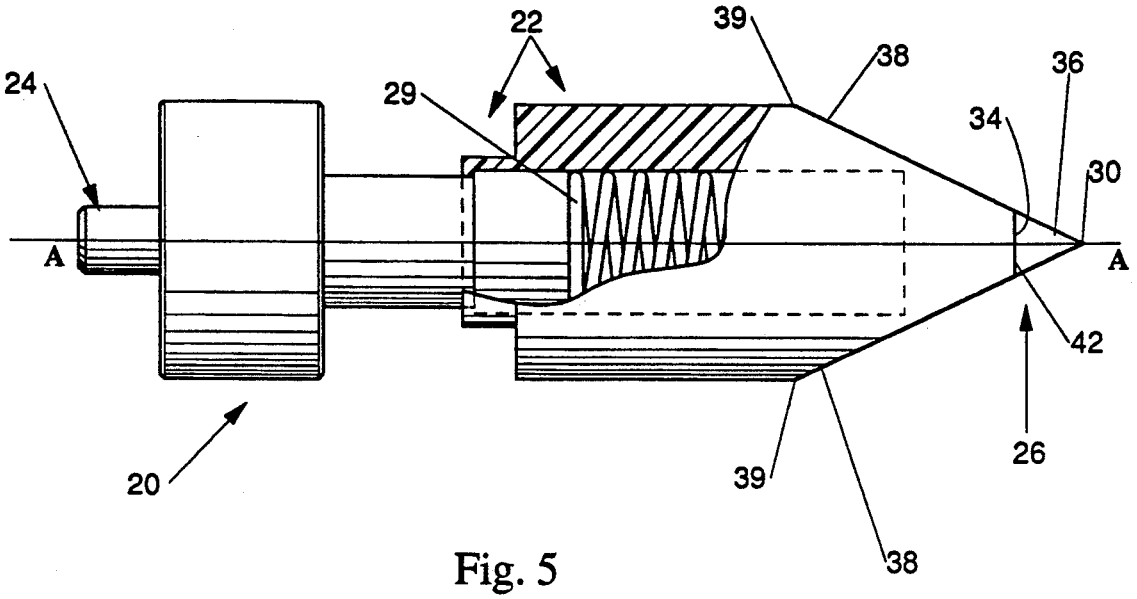
FIG. 5 is a side elevational view of the spindle depicted in FIG. 4.

This second embodiment provides the advantage that it is generally easier to machine or otherwise fabricate a spindle 20 according to the present invention. However, as illustrated in FIG. 5, this embodiment has the disadvantage that there is a blunted surface 42 generally orthogonal the longitudinal axis A—A. The blunted surface 42 defines a frustro-triangular shape near the bases of the cylindrical triangles 36 having apexes at the first edge 30.

Figure 6:
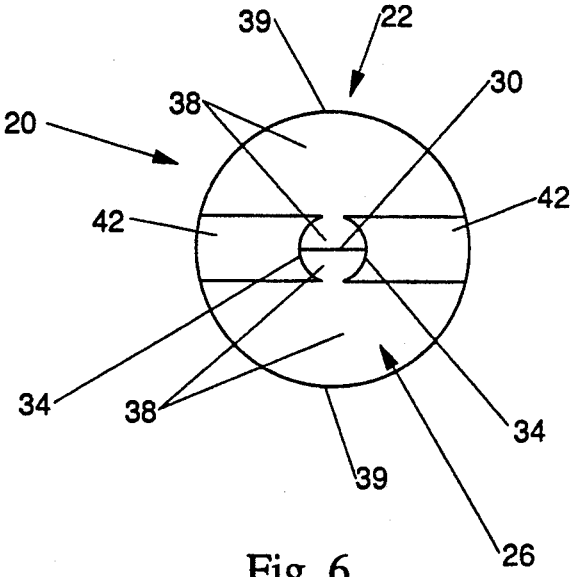
FIG. 6 is an end view of the spindle depicted in FIGS. 4 and 5.

As illustrated in FIG. 6, the blunted surface 42 is preferably substantially mutually parallel to the first edge 30. Alternatively, the blunted surface 42 may be monotonically tapered, if desired, towards one of the parabolic surfaces 38, and particularly towards the bases of one of the circular arcs 34 juxtaposed with the first edge 30.

This blunted surface 42 replaces the second edge 40 in the first illustrated embodiment. The blunted surface 42 may prevent the spindle 20 from being easily inserted into the compressed core, particularly if the first edge 30 of the second end 26 is not substantially parallel the major axis of the cross section of the end of the compressed core.

In another alternative embodiment (not shown) the means for inserting the second end 26 of the spindle 20 into the core of the compressed core wound paper product may comprise a surface defining an arc 34 of a circle which is generally orthogonal to and at least partially circumscribes the longitudinal axis A—A of the spindle 20. However, such surface need not be defined by a cylindrical triangle 36, but rather may be formed by a frustro-cone or a spherical triangle. As used herein a "spherical triangle" is a shape having three vertices connected by generally straight lines and which can be taken from the surface of a sphere. In a similar manner, the means for expanding the compressed core to a generally circular cross section may comprise a frustro-cone or a spherical triangle, rather than the aforementioned cylindrical triangle 36.

Generally, embodiments utilizing a spherical triangle or a frustro-cone, rather than the aforementioned cylindrical triangular shaped means for inserting one end of the spindle 20 into the core and the aforementioned cylindrical triangular shaped means for expanding the core to a generally circular cross section, are less preferred than the two illustrated embodiments. The preference for the illustrated embodiments is due to the hazards inherent with a more pointed spindle 20 and the omission of the linear first edges 30 which approximate the major axis of the core when compressed.

Combining the second and third embodiments, the spherical triangular means for inserting one end of the spindle 20 may be collinear with the spherical triangular means for expanding the compressed core to a circular cross section. It will be apparent to one skilled in the art that many other variations are possible, all of which are within the scope and intent of the following claims.

What is claimed is:

1. A spindle for use with core wound paper product, said spindle having a longitudinal axis and comprising:

a first end having a circular cross section and adapted to fit onto a dispenser;

a second end opposite said first end and tapering to an edge which intersects said longitudinal axis of said spindle and orthogonal thereto, said edge being juxtaposed with at least one surface defining an arc of a circle, said arc at least partially circumscribing said longitudinal axis and being generally orthogonal thereto so that said second end is adapted to fit onto dispenser;

a generally tubular means for connecting said first end and said second end to each other; and a means for outwardly biasing said second end from said first end.

2. A spindle according to claim 1 further comprising a second edge having a vector component orthogonal to said longitudinal axis and disposed longitudinally inward and radially outward of said first edge.

3. A spindle according to claim 2 wherein said first edge and said second edge are substantially mutually parallel.

4. A spindle according to claim 1 further comprising a blunted surface having a vector component orthogonal to said longitudinal axis and disposed longitudinally inward and radially outward of said first edge.

5. A spindle according to claim 4 wherein said first edge and said blunted surface are substantially mutually parallel.

6. A spindle according to claim 4 wherein said blunted surface is monotonically tapered towards said circular arc juxtaposed with said first edge.

* * * * *

UNITED STATES PATENT AND TRADEMARK OFFICE

CERTIFICATE OF CORRECTION

PATENT NO. : 5,277,375

DATED : JANUARY 11, 1994

INVENTOR(S) : Donald D. Dearwester

It is certified that error appears in the above-identified patent and that said Letters Patent is hereby corrected as shown below:

On the title page: Item [56]

| | |
|---|---|
| Under References Cited U.S. Patent Documents | delete "4,886,167 6/1989" and insert therefor --B1 4,886,167 6/1991--. |
| Column 2, line 10 | delete "4,886,167" and insert therefor --B1 4,886,167--. |
| Column 2, line 21 | delete "Samson" and insert therefor --Sampson--. |
| Column 7, line 62 | delete "al so" and insert therefor --also--. |

Signed and Sealed this

Eighteenth Day of October, 1994

Bruce Lehman

*Attest:*

BRUCE LEHMAN

*Attesting Officer*

*Commissioner of Patents and Trademarks*